United States Patent [19]

Kawabe et al.

[11] 3,932,314

[45] Jan. 13, 1976

[54] HEXABORIDE ELECTRON EMISSIVE MATERIAL

[75] Inventors: Ushio Kawabe, Hamura; Shigehiko Yamamoto, Tokorozawa; Toshiyuki Aita, Kokubunji; Yukio Honda, Hachioji, all of Japan

[73] Assignee: Hitachi, Ltd., Japan

[22] Filed: Sept. 5, 1974

[21] Appl. No.: 503,471

[30] Foreign Application Priority Data

Sept. 5, 1973 Japan ..... 48-99231

[52] U.S. Cl. ..... 252/521; 313/346 R

[51] Int. Cl.[2] ..... H01B 1/06

[58] Field of Search ..... 252/521; 313/346 R

[56] References Cited

UNITED STATES PATENTS 3,312,856 4/1967 Lafferty et al. ..... 313/311

FOREIGN PATENTS OR APPLICATIONS 1,232,523 5/1971 United Kingdom 256,880 7/1970 U.S.S.R. ..... 313/346

*Primary Examiner*—Benjamin R. Padgett

*Assistant Examiner*—E. Suzanne Parr

*Attorney, Agent, or Firm*—Craig & Antonelli

[57] ABSTRACT

An electron emissive material of the formula $(Y_{1-x}EU_x)B_6$ having the calcium hexaboride type crystal structure can easily produce hexaborides of the single phase. These borides have a number of merits such as small work function, high mechanical properties and low vapor pressure, and they are far more excellent than prior-art materials when used in a thermionic emission cathode and a field emission type cold cathode.

6 Claims, 3 Drawing Figures

HEXABORIDE ELECTRON EMISSIVE MATERIAL

BACKGROUND OF THE INVENTION

1. Field of the Invention

This invention relates to a thermionic-electron-emitting or field-emitting material for use in appliances and equipment applying an electron beam. More particularly, it relates to an electron emissive material of ternary system hexaborides having the $CaB_6$ type crystal structure, which is small in the work function and which is chemically stable.

2. Description of the Prior Art

In a variety of appliances and equipments applying an electron beam, there has recently been a strong request for an electron ray source attaining an electron beam of large capacity or an electronic device having a high brightness.

As a cathode material for emitting electrons, tungsten was exclusively used, whether the cathode was of the thermionic emission type or the field emission type. The reason for this use is that tungsten is very suitable for the purpose because it is low in vapor pressure, high in strength and excellent in workability. As the result of the recent advancement of apparatuses applying an electron beam, however, a material having higher degrees of characteristics than those of tungsten has come into demand.

In case of the thermionic emission, the current density $J_s$ (Amp./cm$^2$) of an electron beam is represented by the Richardson-Dushman equation (1):

$$J_s = A\,T^2 \exp(-\phi / k_B T)$$

where $\phi$ denotes the work function (eV), T the temperature (°K) of the tip portion of the cathode at the electron emission, and $k_B$ the Boltzmann's constant. A is called the thermionic emission constant (Amp./cm$^2 \cdot$ K$^2$), which is a constant sensitive to the state of the surface, especially to an adsorbed layer on the surface and the nonuniformity of the surface.

Assuming that A is fixed, it is understood from Equation (1) that as $\phi$ is smaller, the electronic current density $J_s$ becomes larger at low temperatures.

In case of the field emission, the electronic current density $J_s$ (Amp./cm$^2$) is represented by the Fowler-Nordheim equation (2):

$$J_s = a \frac{E^2}{\phi} \exp\left(-b \frac{\phi 3/2}{E}\right) \qquad (2)$$

where E denotes the field strength (V/cm). $a$ and $b$ denote constants which do not involve the work function, and in the case of tungsten, they are known to be $6.2 \times 10^{-6}$ and $6.8 \times 10^7$, respectively.

In order to induce the field emission, an electric field in the order of at least $10^6$ V/cm is generally required. As apparent from Equation (2), even when the work function $\phi$ lowers slightly, the electronic current density $J_s$ remarkably increases even at low applied voltages.

Consequently, in both cases of the thermionic emission and the field emission, the employment of a cathode material of small work function is the first requisite for raising the electronic current density (and accordingly, the brightness).

Even when the work function is small, if the mechanical strength is low the cathode will be destroyed due to an electrostatic force or will be softened due to a high temperature. Therefore, a cathode material which has not only a small work function but also a high mechanical strength must be employed. Moreover, since the cathode is used in an ultrahigh vacuum, the life of the cathode becomes very short when a material of high vapor pressure is used. The cathode material need therefore be a stable material of low vapor pressure.

As cathode materiala fulfilling these requirements, it has hitherto been said that tungsten being a refractory metal and that borides having the calcium boride ($CaB_6$) type crystal structure, especially lanthanum hexaboride ($LaB_6$) are preferable.

The calcium hexaboride type crystal structure belongs to the space group $O_h^1$ -$P_{m3m}$, and is a body-centered cubic lattice. Borides having this type of crystal structure are found among compounds which are obtained through reaction with alkaline-earth metals, rare-earth metals or some transition metals. Most of the borides have such very desirable properties for electron emissive materials, such that the melting point is high, that the vapor pressure is low, and that the hardness is great. Also, the borides are resistant against ion bombardment, and are apt to emit electrons by heat or electric field because the work function is low.

Since lanthanum hexaboride with a work function of about 2.66 eV was found to be suitable as the electron emissive material, 19 sorts of binary system hexaborides having the calcium hexaboride type crystal structure have been discovered. As ternary system or quaternary system hexaborides, (La, Na)$B_6$ and $(Sr_{0.4}La_{0.6})B_6$, for example, have been proposed in Zh Pkh., Vol. 37, 1964, page 1872, by G. D. Samasonor et al. and in British Pat. No. 1,232,523.

However, although the ternary system or quaternary system hexaborides are lower in the work function than lanthanum hexaboride, they are smaller in the thermionic emission constant and are unsatisfactory in practical use. More specifically, the thermionic current densities of these borides at 1000°C. are 0.1 – 0.01 Amp./cm$^2$. The values are somewhat greater than in lanthanum hexaboride, but in the actual use, they are still insufficient and at least about 1 Amp./cm$^2$ is necessary.

It has been known that, among the binary system hexaborides having the calcium hexaboride type structure, yttrium hexaboride ($YB_6$) and gadolinium hexaboride ($GdB_6$) are lower in the work function than lanthanum hexaboride and therefore suitable as a thermionic-electron-emitting material. The yttrium hexaboride and gadolinium hexaboride, however, are difficult to be prepared in the pure form, and are prone to be produced with other borides such as tetraborides, mixed therein. For example, yttrium hexaboride is prone to be produced under the mixed presence of yttrium tetraboride ($YB_4$) and other yttrium borides. It is extremely hard to separate these other borides. The yttrium hexaboride phase which has a low work function and the yttrium tetraboride phase and the other yttrium boride phases which have high work functions are existent at the tip portion of the cathode in the mixed state, so that the current density of the electron emission and accordingly the brightness become unstable.

For such reasons, among the hexaborides having the calcium hexaboride type crystal structure, only lanthanum hexaboride has hitherto been barely permitted to be put into practical use, and the others have been unusable as stable cathode materials.

SUMMARY OF THE INVENTION

An object of this invention is to provide a stable and long-life electron emissive material which has a low work function, which can be readily manufactured as a stable single phase compound and which establishes a high electronic current density.

In order to accomplish the object, this invention substitutes europium (Eu) for part of yttrium (Y) in yttrium hexaboride ($YB_6$).

A temperature range in which the reaction of Equation (3) arises is limited by the temperatures of production of $YB_6$ and $EuB_6$. For this reason, in order to form $(Y_{1-x}Eu_x)B_6$, it is necessary to find the temperature range in which $YB_6$ and $EuB_6$ are respectively, obtained in pure phases.

Table 1 indicates the borothermal reaction temperatures and the states of formed phases on $YB_6$ and $EuB_6$. In the table, ◎ denotes a case where almost all the quantity is occupied by the particular compound, O a case where the particular compound is formed in a small quantity, and X a case where the particular compound is created in a considerably large quantity and where a mixed phase is formed.

TABLE 1

| REACTION CONDITION | $M_2O_3$ + 15B 2$MB_6$+3BO | | | | $M_2O_3$ + 6$B_2O_3$+21C 2$MB_6$+21CO | | | $M_2O_3$+3$B_4C$ 2$MB_6$ + 3CO | | |
|---|---|---|---|---|---|---|---|---|---|---|
| PRODUCTS | 1400°C | 1500°C | 1550°C | 1700°C | 1400°C | 1550°C | 1700°C | 1400°C | 1550°C | 1700°C |
| $YB_4$ | X | X | X | ◎ | ◎ | ◎ | ◎ | ◎ | ◎ | ◎ |
| $YB_6$ | O | ◎ | ◎ | X | X | X | X | X | X | X |
| $YB_{12}$ | ◎ | X | X | X | X | X | X | X | X | X |
| $YB_{66}$ | X | X | X | ◎ | O | ◎ | ◎ | O | O | ◎ |
| $YBO_3$ | ◎ | X | X | X | ◎ | X | X | ◎ | ◎ | X |
| $EuB_6$ | ◎ | ◎ | ◎ | ◎ | ◎ | ◎ | ◎ | ◎ | ◎ | ◎ |

DETAILED DESCRIPTION OF THE INVENTION

Figure 1:
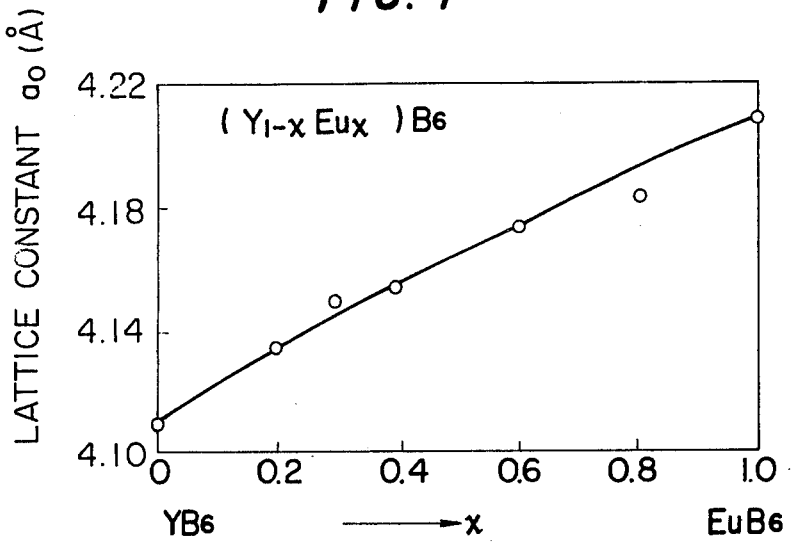
FIG. 1 is a graph which shows the relationship between the lattice constant and $x$ of $(Y_{1-x}Eu_x)B_6$ according to this invention.

As previously explained, yttrium hexaboride is smaller in the work function than lanthanum hexaboride, and is suitable as the electron emissive material. However, it is difficult to be acquired in the single phase, and it cannot conduct a stable electron emission. In contrast, when part of yttrium hexaboride is substituted by europium, the production of other borides such as tetraboride becomes very low, and the hexaboride can be produced in a very pure form. The electron emission can therefore be carried out very stably. In addition, the compounds which are obtained by substituting a part of yttrium hexaboride with europium are, in a certain specific composition range, much smaller in the work function than yttrium hexaboride or europium hexaboride. As the electron emissive material, these compounds achieve characteristics far more excellent than in the prior art.

This invention is based on this finding. Thus this invention consists in forming yttrium europium hexaboride $(Y_{1-x}Eu_x)B_6$ with the calcium hexaboride type crystal structure by substituting europium for part of the yttrium in yttrium hexaboride, and in using it as the electron emissive material.

$(Y_{1-x}Eu_x)B_6$ can be formed by utilizing a borothermal reaction and in conformity with the following equation (3):

$$(1-x)Y_2O_3 + x\,Eu_2O_3 + 15\,B \rightarrow 2\,(Y_{1-x}Eu_x)B_6 + 3\,BO\uparrow \quad (3)$$

As apparent from Table 1, in the case of $YB_6$, at 1700°C., $YB_4$ and $YB_{66}$ are produced in large quantities, and the mixed phases are formed. At 1400°C., large quantities of $YB_{12}$ and $YBO_3$ are coexistent with $YB_6$. Consequently, a stable phase in which $YB_6$ is the principal constituent is acquired in a narrow range of 1500°–1550°C.

On the other hand, $EuB_6$ is stably formed in a wide range of 1400°–1700°C. as seen in the table.

The borothermal reaction conforming to Equation (3) has been explained above. Where the starting materials are changed, the stable phase whose principal constituent is $YB_6$ cannot be formed as seen in Table 1. After all, $(Y_{1-x}Eu_x)B_6$ is formed in the temperature range of 1500°–1550°C. in conformity with Equation (3).

An example of the method of forming $(Y_{1-x}Eu_x)B_6$ will now be described.

Starting materials of $Y_2O_3$, $Eu_2O_3$ and B powders having purities of at least 99.9% were weighed and mixed at predetermined compounding ratios. The mixture was put into a solvent of acetone, and was mixed and pulverized well in an agate mortar. Further, a very small amount of polyvinyl alcohol as a molding agent was added, and the solution was agitated. The solution was dried at 150°C. by a drier for 30 minutes. Thereafter, the mixture was molded into discs by means of a press applying a pressure of about 1 ton/cm$^2$, to make compacts (each being 15 mm. in diameter and approximately 5 mm. in thickness). The compact was received in a boron nitride crucible. It was caused to react at a temperature of 1525°C. for 1 hour in a small-sized Tanmann furnace while establishing a vacuum of $10^{-2}$ – $10^{-3}$ Torr to exhaust the produced BO gas.

In order to prevent carbon of a heating unit of the Tanmann furnace from vaporizing, Ar gas of at least 1 atm. was caused to flow through the heating unit during the heating. Since the reaction itself is a degassing reaction, the heating unit portion and a specimen portion were sealed by alumina crucible so as to be held under the vacuum.

The value of $x$ in $(Y_{1-x}Eu_x)B_6$ was changed to 0, 0.2, 0.3, 0.4, 0.6, 0.8 and 1.0. As the result of the observation of the metal structure and the powder X-ray diffraction, it was revealed that the single phase of the hexaboride was formed in each case.

FIG. 1 shows the results of measurements by the X-ray diffraction on the composition-dependence of the lattice constant $a_o$ in $(Y_{1-x}Eu_x)B_6$. The relationship between the value $x$ and the lattice constant $a_o$ exhibits a good linearity for values from 0 – 1.0 for $x$. It is apparent that $(Y_{1-x}Eu_x)B_6$ forms a single solid solution without having two phases over the full range.

Description will now be made of the work function of $(Y_{1-x}Eu_x)B_6$.

The work function of the material $(Y_{1-x}Eu_x)B_6$ obtained as stated above was measured by the use of the usual Kelvin type vibrating capacity method based on a contact potential difference. More specifically, a capacitor was formed between the opposing poles of the disc-shaped specimen S and a reference specimen (whose value of work function was known) R, and the reference plane was vibrated at a frequency of 20 Hz. The A.C. component of a current due to a contact potential difference thus caused between the specimens S and R was amplified by a preamplifier of high input impedance and a lock-in amplifier. The amplified signal was fed back as a compensating potential difference to the reference plane R. In this way, the work function $\phi_{CPD}$ of the specimen at 300°K was evaluated from the contact potential difference (CPD) of the specimen. In the measurement, a specimen chamber was evacuated to a vacuum of $5 \times 10^{-10}$ Torr and ion bombardment was conducted with $Ar^+$ ions of 1 KV × 15 $\mu$A for several minutes, e.g. 10 min. to subject the specimen to surface treatment, whereupon the work function was evaluated at 300°K. The precision was ± 5 meV.

Figure 2:
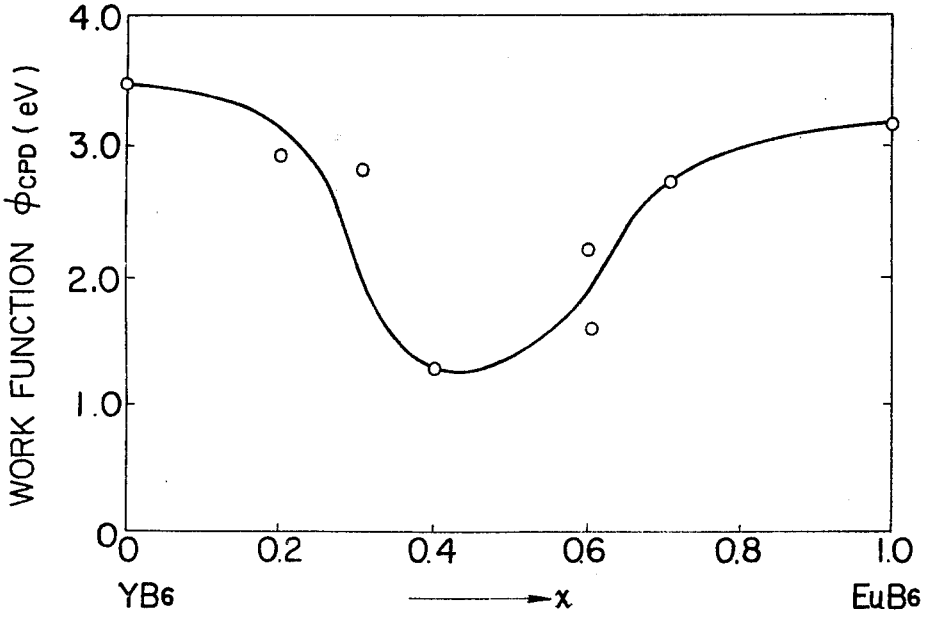
FIG. 2 is a graph which shows the relationship between the work function and $x$ of the material $(Y_{1-x}Eu_x)B_6$.

FIG. 2 is a graph which shows the relationship between the work function $\phi_{CPD}$ and x of $(Y_{1-x}Eu_x)B_6$ at 300°K.

As apparent from the figure, some europium is necessary for obtaining a material having a small work function. Strictly speaking, the europium concentration for a smaller work function materials lies in a range of about 0.2 to 0.8 than either $YB_6$ or $EuB_6$. Europium-yttrium hexaboride in the above-mentioned range is harder to separate into other borides with larger work function, and so it has stable emission properties. The work function $\phi_{CPD}$ is small in a range of $x$ of about 0.3 – 0.7, and is particularly small in a range of 0.3 – 0.6. Accordingly, $(Y_{1-x}Eu_x)B_6$ for use as the electron emissive material should suitably have a composition of a range of $x$ of 0.3 – 0.7.

As stated above, the hexaboride of $(Y_{1-x}Eu_x)B_6$ ($0.3 \leq x \leq 0.7$) is very small in the work function at the normal temperature, and is therefore a material effective for a field emission type cold cathode. An electron ray source of high brightness can be easily obtained.

Description will now be made of the thermionic emission characteristic of $(Y_{1-x}Eu_x)B_6$ according to this invention.

The measurement of the thermionic emission characteristic was carried out as explained below by the use of a common hot cathode tester. From the specimen prepared by the method previously set forth, a specimen having a sectional area of about 3 mm² and a length of about 10 mm was cut out. It was held between electrode blocks made of molybdenum. Further, on a principal axis in the direction of the vertical bisector of the specimen, a slit plate having an aperture diameter of 1.5 mm. and a Faraday collector were, respectively, placed perpendicularly to the principal axis. The distance between the specimen and the slit plate was not greater than 1 mm. The specimen was heated in such a way that an A.C. current of 20 A at the maximum was conducted directly through the specimen. The temperature was measured by a pyrometer through a view port located on the opposite side of the specimen. As an acceleration voltage a D.C. voltage of 5 KV at the maximum was applied via an ammeter between the side of a specimen electrode equal in potential to the slit and the Faraday collector, so as to collect thermions towards the Faraday collector. Using the temperature T (°K) measured by the pyrometer and the current I (A) measured by the ammeter at this time, Richardson plots were obtained. The evacuation of a specimen chamber was performed by an ion pump, and the degree of vacuum was $10^{-6} - 10^{-7}$ Torr.

Figure 3:
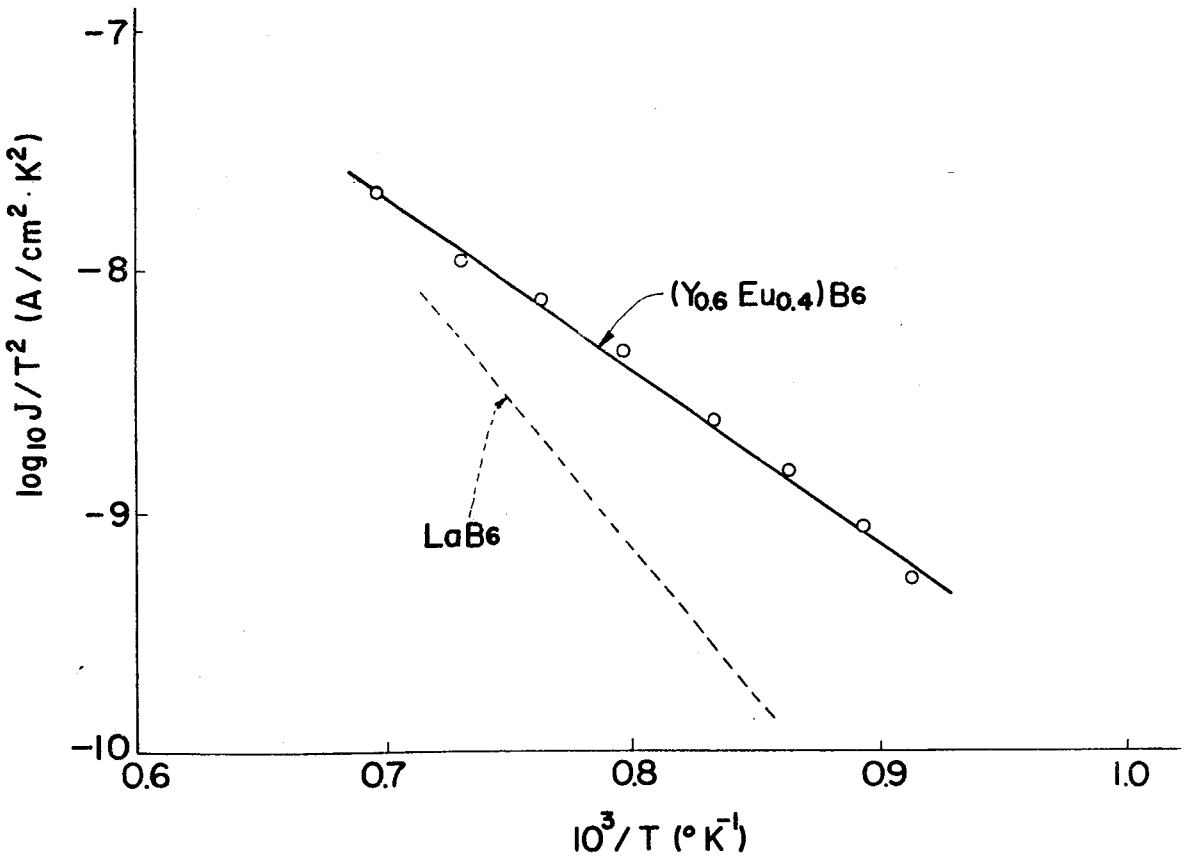
FIG. 3 is a graph which shows Richardson plots on the thermionic emission of $(Y_{0.6}Eu_{0.4})B_6$ according to this invention.

As shown in FIG. 2, the composition at which the work function $\phi_{CPD}$ of the $(Y_{1-x}Eu_x)B_6$ system at 300°K becomes smallest is at $x = 0.4$. The thermionic emission characteristic at $x = 0.4$ was therefore investigated. FIG. 3 shows the Richardson plots of $(Y_{0.6}Eu_{0.4})B_6$ at 1100° to 1500°K. The plots were taken as $\log_{10}J/T^2$ versus $10^3/T$ where J denotes the current density (A/cm²) owing to the thermionic emission and T the temperature (°K) of the specimen. As apparent from FIG. 3, the thermionic emission of $(Y_{0.6}Eu_{0.4})B_6$ at 1200°K is approximately 7 times as great as that of $LaB_6$. The work function of $\phi_{TE}$ in the thermionic emission as evaluated from the gradient of a straight line of the Richardson plots in FIG. 3 is 1.46 eV. This value is slightly different from the value of the work function as evaluated from the contact potential difference, and the disparity will be ascribable to the temperature-dependence of the work function.

As described above, the hexaboride of $(Y, Eu)B_6$ is smaller in the work function and remarkably greater in the characteristic of thermionic emission than $LaB_6$ even at high temperatures of about 1200°K, so that it is also effective for a hot cathode. Accordingly, an electron ray source of high brightness can be easily acquired.

What is claimed is:

1. An electron emissive material which has a calcium hexaboride type crystal structure and which is represented by a general formula of $(Y_{1-x}Eu_x)B_6$ where $0<x<1$.

2. The electrom emissive material according to claim 1, wherein the value $x$ lies in a range of 0.2 to 0.8.

3. The electron emissive material according to claim 1, wherein the value $x$ lies in a range of 0.3 to 0.7.

4. The electron emissive material according to claim 1, wherein the value $x$ lies in a range of 0.3 to 0.6.

5. The electron emissive material according to claim 1, which is used in a thermionic emission cathode.

6. The electron emissive material according to claim 1, which is used in a field emission type cold cathode.

* * * * *